US009879397B2

(12) United States Patent
Marano et al.

(10) Patent No.: US 9,879,397 B2
(45) Date of Patent: Jan. 30, 2018

(54) STRAND PRESSURE-PIPE ANCHOR

(71) Applicant: DYWIDAG-Systems International GmbH, München (DE)

(72) Inventors: Florian Marano, München (DE); Patrick Wörle, Pflach (AT)

(73) Assignee: DYWIDAG-Systems International GmbH, München (DE)

( * ) Notice: Subject to any disclaimer, the term of this patent is extended or adjusted under 35 U.S.C. 154(b) by 0 days.

(21) Appl. No.: 15/111,657

(22) PCT Filed: Dec. 30, 2014

(86) PCT No.: PCT/EP2014/079455
§ 371 (c)(1),
(2) Date: Jul. 14, 2016

(87) PCT Pub. No.: WO2015/106950
PCT Pub. Date: Jul. 23, 2015

(65) Prior Publication Data

US 2016/0326709 A1 Nov. 10, 2016

(30) Foreign Application Priority Data

Jan. 16, 2014 (DE) ..... 10 2014 200 685

(51) Int. Cl.
*E02D 5/80* (2006.01)
*E02D 17/04* (2006.01)

(52) U.S. Cl.
CPC ..... *E02D 5/805* (2013.01); *E02D 17/04* (2013.01)

(58) Field of Classification Search
CPC ..... E21D 21/008; E02D 5/805
USPC ..... 405/259.1, 259.4, 288, 302.2; 52/223.13, 52/155, 156
See application file for complete search history.

(56) References Cited

U.S. PATENT DOCUMENTS

2008/0302035 A1* 12/2008 Shin ..... E02D 5/765 52/223.13

FOREIGN PATENT DOCUMENTS

| | | |
|---|---|---|
| EP | 1373644 | 1/2013 |
| WO | 02/077372 | 10/2002 |
| WO | 2007/066860 | 6/2007 |

OTHER PUBLICATIONS

International Search Report filed in PCT/EP2014/079455 dated Mar. 17, 2015.
German Search Report dated Mar. 10, 2016.

* cited by examiner

*Primary Examiner* — Sean D Andrish
(74) *Attorney, Agent, or Firm* — Rankin, Hill & Clark LLP

(57) ABSTRACT

A strand pressure-pipe anchor comprises a compression anchor base element, a tension strand or a plurality of tension strands, and at least one sheath, in which the tension strand or at least one of the tension strands is received. The tension strand or at least one of the tension strands is provided, at the end thereof associated with the compression anchor base element, with a crimp sleeve, which is provided with an external thread, which, in a connected state of the tension strand and the compression anchor base element where the tension strand is connected to the compression anchor base element to pass on the anchoring forces to the surrounding substratum, is in screw engagement with an internal thread of the compression anchor base element.

19 Claims, 5 Drawing Sheets

STRAND PRESSURE-PIPE ANCHOR

Geotechnical anchors, which also include the conventional strand compression anchor, are used among other things in construction projects, so as to secure the side walls of the construction pit against collapse, for example by way of rear-anchored supporting walls. The pressure forces exerted on the supporting walls by the substratum directly adjacent to the supporting walls are passed to the substratum further away via a plurality of geotechnical anchors. Since, in particular in inner-city construction projects, the anchors protrude into the substratum of the adjacent plot, where they can impede future construction projects, the use of geotechnical anchors is subject increasingly often to the requirement that no parts, or merely steel parts of limited dimensions, may be left in the ground after the construction activities are complete.

In principle, depending on the construction of the tension elements, there is a distinction to be made between two types of anchors: on the one hand, bar anchors, in which the tension element is formed by a rigid steel bar, and on the other hand, strand anchors, in which the tension element is formed by a steel strand. Strand anchors have the advantage over bar anchors that they are more cost-effective to manufacture for the same carrying capacity. Further, they can be delivered wound up, meaning that larger anchor lengths are possible, without couplings attached at the construction site, than for bar anchors, the maximum supply length of which is usually limited to 18 m.

Further, depending on the manner in which the anchor tensioning force is introduced into the surrounding substratum, a distinction is made between connection anchors and pressure-pipe anchors.

In a connection anchor, the tension element connecting the supporting wall to the anchor base element is embedded, at least for part of the length thereof, known as the grout length, in the grout body, which is usually formed from set cement. In the region of the exposed anchor length, the connection between the tension element and the surrounding cement is interrupted, for example by a casing by way of a plastics pipe. Therefore, the tensioning force of the tension element is constant here, and subsequently decreases continuously within the grout body from the start of the grout length to the anchor base element. The anchor tensioning forces are predominantly transmitted to the surrounding substratum by tensile loading of the grout body.

Usually, connection anchors can only be removed in part. Specifically, only the length portion thereof corresponding to the exposed anchor length can be removed again, whilst the length portion thereof corresponding to the grout length remains in the substratum. The predetermined break point between the two length portions may for example be provided when manufacturing the anchor strand by inductively heating the transition region between the two length portions. As a result, however, the total carrying capacity of the anchor strand also decreases at the same time. There are also solutions in which the anchor strand is not weakened until during the removal, by heating. In this case, however, the elements required for this purpose, for example cables and heating elements, already have to be installed as well during production, making the construction complex and expensive. These statements regarding inductive heating apply analogously to mechanical weak points provided during manufacture.

A problem which should not be underestimated is that the anchor strands have to be placed under tensile stress during removal so as to cause the predetermined break point to break. When the predetermined break point breaks, this tensile stress is immediately released, and this often leads to the anchor strand shooting out of the anchoring hole. It is easy to see that this involves a considerable risk of injury for the staff removing the anchor strand. Attempts are made to reduce this risk, using complex and therefore costly measures such as safety nets. However, it cannot be entirely eliminated.

In fully removable connection anchors, the grout region has to be destroyed before the anchor strand is removed. This may be achieved for example by detonating an explosive charge, by applying a transverse tensile stress using a strand provided specifically for this purpose, or by way of liquid jets ejected from high-pressure nozzles. However, all of these measures require special provisions which complicate the construction of the connection anchor.

By contrast, in a pressure-pipe anchor, the tension element is enclosed over the entire anchor length by a sheath which protects the tension element from direct contact with the grout body formed from set cement mortar. In the pressure-pipe anchor, the tensile force of the tension element, which is constant as far as the anchor base element, is transmitted completely to the anchor base element via a short connecting length. From here, it is subsequently transmitted to the surrounding substratum, if necessary with the assistance of a pressure pipe which cooperates which the anchor base element, by compressive loading of the grout body.

WO 2002/077372 A1 discloses a conventional, fully removable strand pressure-pipe anchor. Anchor tensile forces are transmitted from the strand to the anchor base element by way of a plurality of wedge elements. The wedge elements are in retaining engagement with the surface of the strand via a toothing, said engagement being maintained as a result of the tensile stress on the strand from the cooperation between the wedge faces of the wedge elements and counter wedge faces of the anchor base element. Further, the strand pressure-pipe anchor known from WO 2002/077372 A1 comprises a substantially T-shaped element, which is in entraining engagement with the ends of the wedge element via the cross-piece of the T shape. In addition, the base piece of the T shape comprises an external thread, which is intended to cooperate with a counter thread formed in a depression in the anchor base element.

After the strand pressure-pipe anchor has been used, the strand is removed as follows. Initially, by compressive loading of the strand, the engagement between the wedge elements and the wedge faces of the anchor base element is released. Subsequently, the strand is fully inserted into the anchor base element. It thus entrains the T-shaped element via the wedge elements until said element is positioned against the opening in the threaded depression of the anchor base element. Subsequently, the T-shaped element is screwed into the threaded depression by rotating the strand and entraining the wedge elements. Entraining the wedge elements releases the contact between the strand and the wedge segments, making it possible to pull the strand out of the anchor base element and thus out of the entire drill hole.

It can easily be seen that a first drawback of the construction known from WO 2002/077372 A1 is that the release of the wedge elements is decisive for the possibility of fully removing the strands. Especially in long strand anchors connected at high biasing forces, the release by applying a compressive load can lead to problems. So as to be able to release the wedge elements in a simple manner, the surfaces thereof have to be appropriately hardened, or the load factor of the strands has to be limited. In addition, the construction known from WO 2002/077372 A1 requires the use of a large number of components. Thus, in addition to providing the wedge elements and the substantially T-shaped element, the anchor base element has to be formed in two pieces, so as to be able to provide both the wedge faces and the threaded depression.

An object of the present invention is to specify a conventional strand pressure-pipe anchor which is of a simpler construction and can in addition be removed in a simple, rapid manner.

This object is achieved according to the invention by a fully removable strand pressure-pipe anchor of the conventional type in which the tension strand or at least one of the tension strands is provided, at the end thereof associated with the compression anchor base element, with a crimp sleeve, which is provided with an external thread, which, in a connected state of the tension strand and the compression anchor base element where the tension strand is connected to the compression anchor base element to pass on the anchoring forces to the surrounding substratum, is in screw engagement with an internal thread of the compression anchor base element. Preferably, all tension strands are screwed to the compression anchor base element via a crimp sleeve provided with an external thread.

According to the invention, for each fully removable tension strand, merely one additional element is required, specifically the crimp sleeve provided with the external thread. Said sleeve is screwed directly to the compression anchor base element. Therefore, the tension strand can be unscrewed from the compression anchor base element again in a simple manner after use. It is advantageous for the direction of lay of the tension strand to be the same as the rotational direction of the thread of the crimp sleeve arranged at the free end thereof. If the crimp sleeve is provided with a right-handed thread, in other words a thread formed in such a way that clockwise rotation is required to screw said sleeve into the compression anchor base element when viewed in the screwing-in direction, the wires forming the strand also extend to the right towards the crimp sleeve. Because the crimp sleeve thread and the strand direction of lay are in the same direction, the tension strand contracts during unscrewing, in such a way that the wires of the strand do not open, but instead are pressed more tightly together and support one another. The strand thus has greater torsional rigidity over the entire length thereof, and can be unscrewed from the compression anchor base element in a simple manner even if is only gripped at the end thereof remote from the compression anchor base element.

Not only can the sheath be used to prevent the tension strand from becoming fully embedded in the grouting material, but it can also be used to protect the screw connection against an effect, in particular a fixing effect, of the grouting material. For this purpose, it is advantageous if the sheath or at least one of the sheaths is connected to the compression anchor base element in a sealing manner. As a result, penetration of the material used for grouting, in particular cement, can be prevented, so as not to impede the unscrewing of the tension strands.

For example, the compression anchor base element may comprise, on the surface thereof facing the tension strand or the plurality of tension strands, a depression for the sheath or at least one of the sheaths, into which depression the free end of an associated sheath can be inserted. This insertion is already sufficient to produce a type of labyrinth seal effect, which protects the screw connection against the penetration of the material used for grouting. This sealing effect can be reinforced by arranging the sheath in the depression in the press fit.

In addition or alternatively, it may be provided that the sheath is screwed to the compression anchor base element. For example, the sheath may be screwed into the depression in the compression anchor base element. In principle, however, it is also possible for the sheath to be screwed to the compression anchor base element using special sealing means.

To simplify the construction of the strand pressure-pipe anchor according to the invention further, it is proposed that, if a plurality of tension strands are provided, a specific sheath is associated with at least one tension strand, preferably all tension strands. Because there is not a specific sheath associated with each tension strand, the number of components required for the construction of the strand pressure-pipe anchor according to the invention can be further reduced.

As is known from pressure-pipe anchors per se, the strand pressure-pipe anchor according to the invention may further comprise at least one pressure body, which cooperates with the compression anchor base element in passing the anchoring forces to the surrounding substratum. This pressure body may enclose the tension strand or the plurality of tension strands, and have an end face thereof which faces the compression anchor base element and is positioned, preferably in a planar manner, against the compression anchor base element or a further pressure body for effectively passing on the compressive forces.

On the outer peripheral face thereof, the pressure body may have at least one depression extending substantially in parallel with the longitudinal extension direction of the tension strand or the plurality of tension strands. A supply line for supplying grouting material, for example, may be laid in a depression of this type.

Further, a plurality of ribs extending in the peripheral direction, which can improve the retention in the surrounding substratum, may be provided on the outer face of the pressure body.

Further, in the peripheral direction at the point where a through-opening, intended for passing the tension strand or one of the tension strands through, extends furthest radially outwards, the pressure body may be formed free of ribs extending in the peripheral direction. The pressure body or bodies remain in the substratum together with the compression anchor base element after the tension strands are removed. During construction operations in this substratum, it should be possible for the pressure body to be broken up very easily, for example by an excavator shovel or a tunnel drilling machine. This is facilitated by the predetermined break points provided according to the invention, which are formed by the peripheral positions which are free of the ribs extending in the peripheral direction. It is also favourable, for this purpose, to manufacture the pressure body from a brittle material, for example cast iron, concrete, mortar, glass, ceramics or the like, since this breaks up relatively easily.

It should further be noted that it is advantageous for the sheath to be dimensioned and/or formed, at least at the end portion thereof adjacent to the compression anchor base element, in such a way that, during introduction into the sheath connected to the compression anchor base element, the external thread of the crimp sleeve of the associated tension strand is simply inserted into the internal thread of the compression anchor base element by the insertion movement of the tension strand. As a result, if it is desired to release the tension strand from the compression anchor base element again for any reason, it is not also necessary to release the associated sheath from the compression anchor base element, and it is still possible to be certain that the screw engagement between the external thread of the crimp sleeve of the associated tension strand and the internal thread of the compression anchor base element can readily be re-established. For example, the sheath may be formed with guide ramps at the end portion thereof adjacent to the compression anchor base element. However, it is also conceivable for the play between the sheath and the crimp sleeve to be dimensioned in such a way that it is less than twice the difference between the nominal diameter and the core diameter of the external thread of the crimp sleeve, preferably less than this difference.

In the following, the invention will be described in greater detail by way of embodiments with reference to the accompanying drawings, in which.

Figures 1, 2, 3:
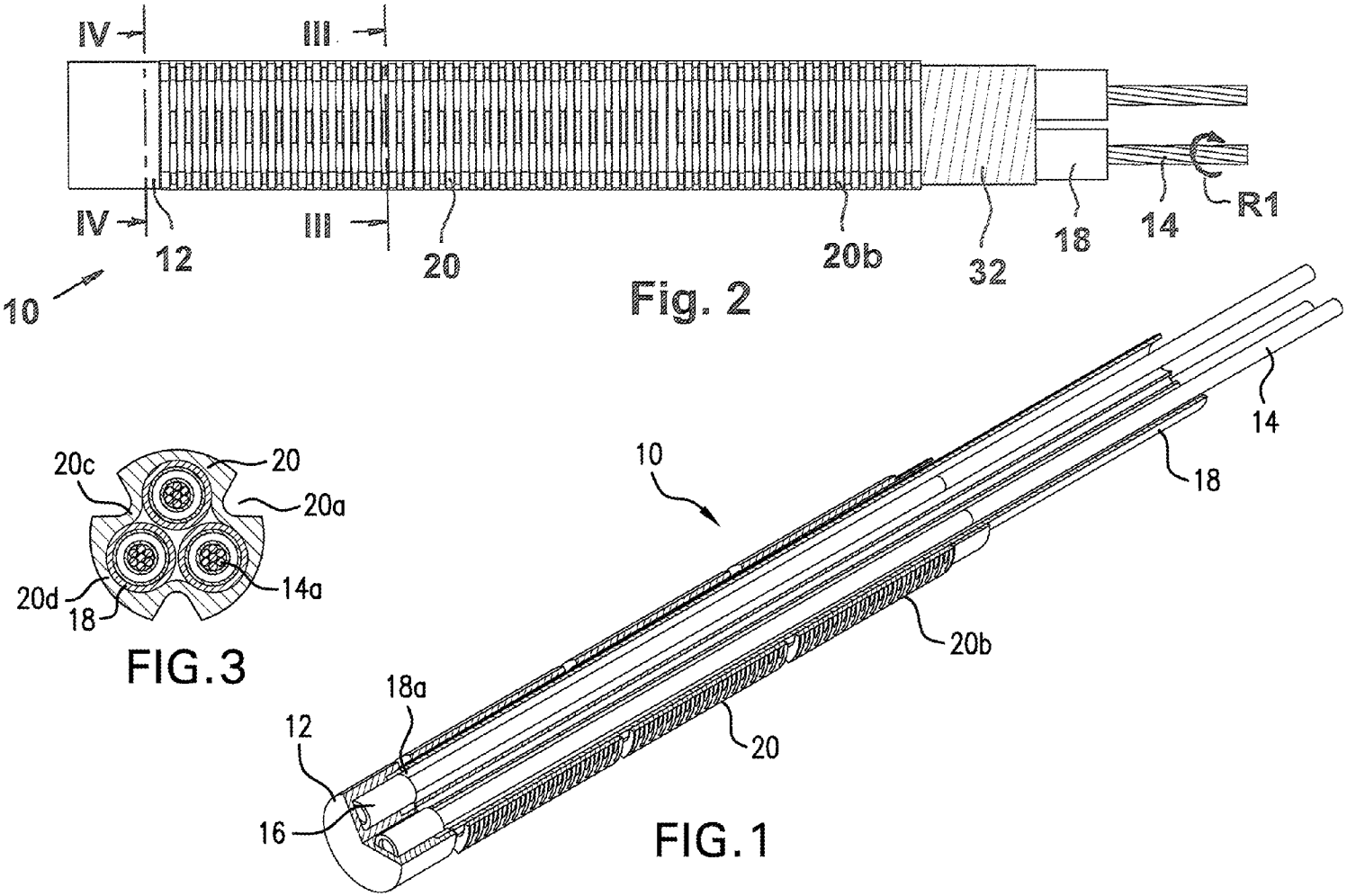
FIG. 1 is a partially sectional perspective view of a first embodiment of a strand pressure-pipe anchor according to the invention, which comprises three strands.
FIG. 2 is a side view of the strand pressure-pipe anchor of FIG. 1.
FIG. 3 is a sectional view of the strand pressure-pipe anchor of FIGS. 1 and 2, taken along the lines III-III, in other words in the region of a pressure body.

In FIGS. 1 and 2, a strand pressure-pipe anchor according to the invention is denoted completely generally as 10. It comprises a foot box 12, which forms the compression anchor base element according to the invention, three strands 14, which are fixed in the foot box 12 by way of crimp sleeves 16, three sheaths 18, each of which encloses one of the strands 14, and pressure bodies 20, to which the foot box 12 passes on the tensile forces, transmitted thereto from the strands 14, as compressive forces.

Figure 4:
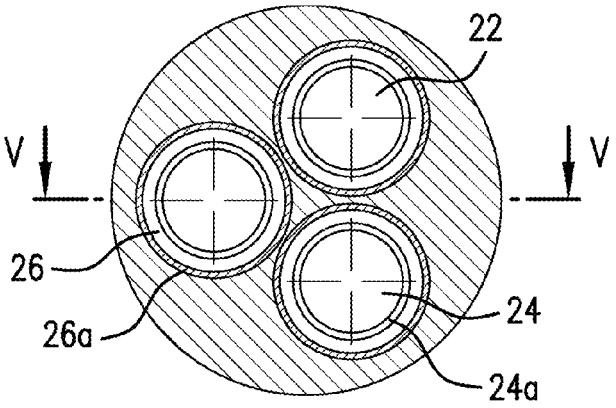
FIG. 4 is a sectional view of the strand pressure-pipe anchor of FIGS. 1 and 2, taken along the lines IV-IV, in other words in the region of the foot box.
Figure 5:
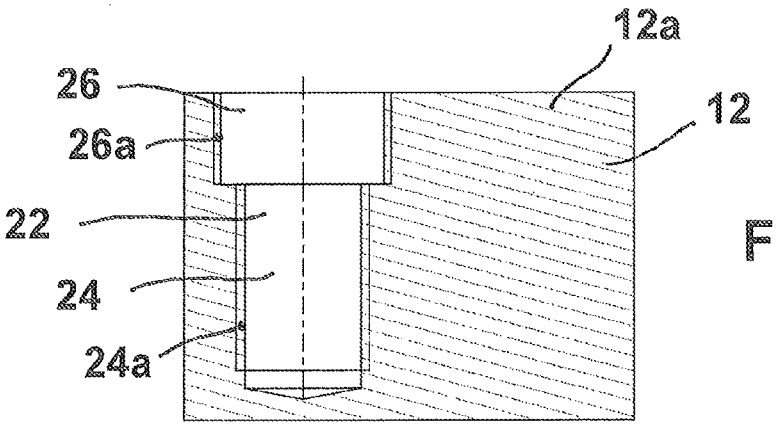
FIG. 5 is a sectional view of the foot box of FIG. 4, taken along the lines V-V.
Figure 6:
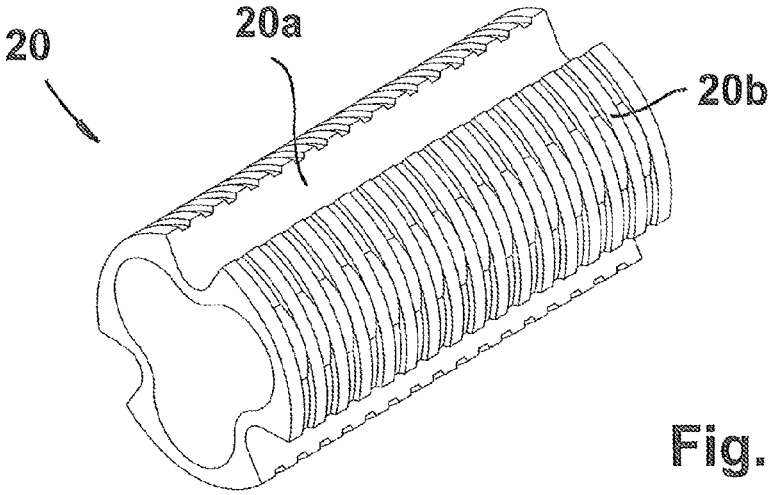
FIG. 6 is a perspective view of a pressure body.

As can be seen in particular from FIGS. 4 and 5 viewed in conjunction, for each of the three strands 14 the foot box 12 has a stepped receiving hole 22, having a portion 24 that has a smaller diameter, is arranged so as to be deeper in the foot box and is provided with an internal thread 24*a*, and having a portion 26 that has a larger diameter, is arranged so as to be adjacent to the surface 12*a* of the foot box 12 and is also provided with an internal thread 26*a*. The portion 24 having a smaller diameter is used to fix the crimp sleeve 16, which is pressed onto the associated strand 14 and provided with an external thread 16*a*, whilst the portion 26 having a larger diameter is used to fix the sheath 18 enclosing the associated strand.

To manufacture the strand pressure-pipe anchor 10 according to the invention, it is possible for example to proceed as follows.

In a first step, the crimp sleeves 16 are pressed onto the associated strands 14. Each crimp sleeve 16 comprises a base body 28 (see FIG. 7), made of a deformable material, for example bright steel, machining steel or tempering steel, and an insertion sleeve 30, which ensures secure retention of the base body 28 on the strand 14. For this purpose, the insertion sleeve 30 is formed with a toothing both on the inner face thereof and on the outer face thereof. When the crimp sleeve 16 is pressed onto the strand 14, these two toothings dig into the material of the base body 28, on the one hand, and into the material of the strand 14, on the other hand. Further, the insertion sleeve 30 may be formed as a longitudinally slotted sleeve, in such a way that it can be positioned fully against the outer surface of the strand 14 when the crimp sleeve 16 is pressed onto the strand 14, without actually experiencing significant plastic deformation. The insertion sleeve 30 may for example be made of bright steel, machining steel or tempering steel.

Figure 7:
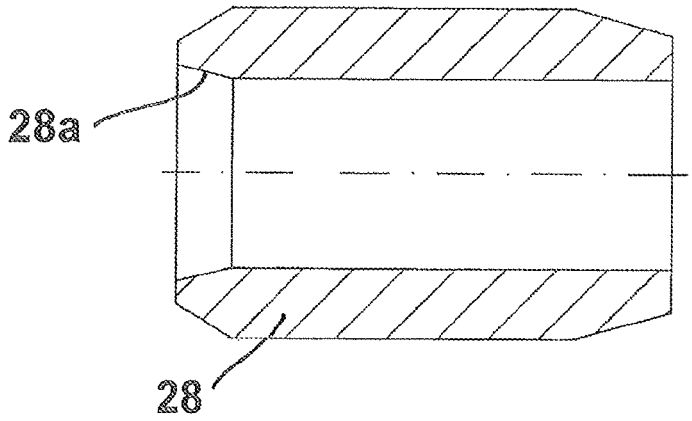
FIG. 7 is a longitudinal section through the base body of a crimp sleeve.
Figure 8:
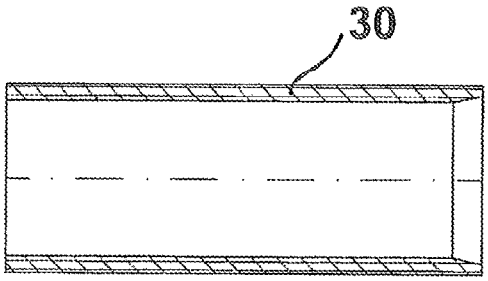
FIG. 8 is a longitudinal section through an insertion sleeve, which, when inserted into the base body, forms the crimp sleeve together therewith.
Figure 9:
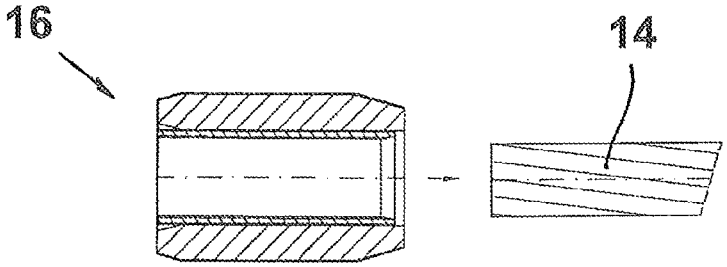
FIG. 9 is a drawing illustrating inserting a strand into the crimp sleeve.
Figure 10:
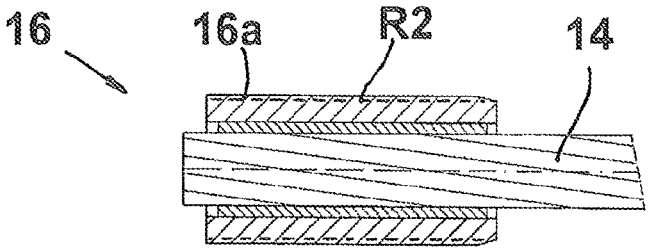
FIG. 10 is a drawing illustrating pressing the crimp sleeve onto the strand.

To press the crimp sleeves 16 onto the associated strands 14, initially the insertion sleeves 30 are inserted into the base body 28 from the left in FIG. 7. This is facilitated by an insertion ramp 28*a*. Subsequently, the crimp sleeve 16 thus formed is placed on the associated strand 14 from the left in FIG. 9 until the strand 14 projects out from the crimp sleeve 16 slightly on the other side, for example by between approximately 5 mm and approximately 10 mm. Thereupon, the actual pressing-on can be achieved by plastic deformation of the base body 28. In this context, as can be seen from a comparison of FIGS. 9 and 10, the base body 28 is both reduced in external diameter and lengthened slightly. Finally, the external thread 16*a* is cut into the outer peripheral face of the base body 28 of the crimp sleeve 16.

In a second step, the strands 14 thus prepared are inserted into the associated sheath 18. Advantageously, the sheaths 18, which are preferably made of plastics material, for example polyethylene (PE), are also provided with an external thread 18*a* at the end from which the crimp sleeves 16 project.

In a third step, the desired number of strands 14, in the present embodiment therefore three strands 14, are combined, and the required number of pressure bodies 20 are slid onto the strands 14.

Subsequently, for mounting the strands 14, the strands 14 are guided in succession to the foot box 12. To fix a strand 14 in the foot box 12, the external thread 16*a* of the crimp sleeve 16 pressed onto the strand 14 is screwed into the internal thread 24*a* of the portion 24 having a smaller diameter. Subsequently, the external thread 18*a* of the sheath 18 is screwed into the internal thread 26*a* of the portion 26 having a larger diameter, resulting in a sealing engagement between the foot box 12 and the sheath 18, in particular an engagement which seals against the penetration of cement mortar.

In an alternative embodiment, in the foot box 12 the formation of the internal thread 26*a* in the portion 26 having a larger diameter could be omitted, and on the sheath 18 the formation of the external thread 18*a* could be omitted. In this case, the sealing engagement between the foot box 12 and the sheath 18 could be provided using a press fit between the foot box 12 and the sheath 18.

Subsequently, the pressure bodies 20 are further slid onto the foot box 12, until they are positioned, at the end faces, against this or against the respectively adjacent pressure bodies 20 for the subsequent transmission of compressive forces. This state is secured by a securing unit 32, for example an adhesive tape, a shrink sleeve, an electrofusion coupler or the like. This securing unit 32 may further have the object of preventing or at least impeding the penetration of cement mortar between the sheath 18 and the pressure body 20.

In the state thus obtained, the strand pressure-pipe anchor 10 is prepared for insertion into and anchoring in the drill hole provided therefor at the construction site.

The removable strand pressure-pipe anchors 10 are pre-assembled at the factory, wound up and delivered to the construction site. After drilling, the pre-prepared anchors can be inserted into the drill hole immediately. In principle, it is also conceivable to assemble the strand pressure-pipe anchors on the construction site. However, preassembly at the factory has the advantage that additional operations on the construction site, which could impede activity on the building site, are avoided.

Once the strand pressure-pipe anchor 10 has been inserted into the drill hole, which is usually sloped down into the soil, said anchor should subsequently be fixed therein, for example using cement mortar. To be able to ensure that the foot box 12 and the pressure body 20 are fully embedded in cement mortar, the pressure bodies 20 are formed, as can best be seen from FIGS. 3 and 5, with longitudinal depressions 20*a*, into which supply lines (not shown) for cement mortar can be laid. If desired, these longitudinal depressions may also continue in the outer peripheral face of the foot box 12, as can be seen in FIG. 1. Further, the pressure bodies 20 are formed with peripheral ribs 20*b*, which provide better anchoring of the pressure bodies 20 in the cement mortar.

Once the cement mortar is cured, to secure the construction pit, the strand pressure-pipe anchor 10 can be braced using a supporting wall provided for this purpose. During the grouting using cement mortar, the sheaths 18 and the sealing engagement thereof with the foot box 12 ensure that the strands 14 do not come into contact with the cement mortar. The tensile forces applied to the strands 14 used as tension elements are therefore fully transmitted to the foot box 12, which passes them on via the end face 12*a* thereof to the pressure bodies 20 as compressive forces. From the foot box 12 and the pressure bodies 20, the forces are subsequently dissipated to the surrounding soil via the grout body, in other words the cured cement mortar.

Once it is no longer necessary to secure the construction pit, the strands 14 and the sheaths 18 enclosing them can be fully removed again. For this purpose, it is merely necessary to release the threaded engagement between the external thread 16*a* of the crimp sleeve 16 pressed onto the strand 14 and the internal thread 24*a* of the portion 24 having a smaller diameter of the foot box 12. This threaded engagement can be released in a particularly simple manner if the direction of lay R1 of the strands 14 (see FIG. 1) is the same as the rotational direction R2 of the thread 16*a* of the crimp sleeve 16 (see FIG. 10). In this development of the invention, the strands 14 contract when being pulled out from the foot box 12, in such a way that the wires of each strand 14 do not open, but instead are pressed more tightly together and support one another. The strand 14 thus has greater torsional rigidity over the entire length thereof, and can be unscrewed from the foot box 12 in a simple manner, for which purpose it need only be gripped at the end thereof remote from foot box 12.

Even though the two directions R1 and R2 are right-handed in the embodiment shown, in other words the external wires extend in the direction of clockwise rotation during movement along the strands 14, a left-handed lay of the strands in conjunction with a left-handed thread in the foot box is also conceivable.

At this point, it should be noted that, although the strands 14 are each formed from seven wires 14*a* in the embodiment shown, the present invention is not limited to strands of this type. Strands having a smaller number of wires, for example three wires, or a larger number of wires, for example nineteen wires, may equally be used.

It should further be noted that the foot box 12, the pressure bodies 20 and the sheath 16 are left in the soil after the removal of the strands 14. So as not to unnecessarily impede subsequent construction activities on the plot in the soil of which these elements are left, the pressure bodies 20 are formed with predetermined break points 20*c* and 20*d*. For this purpose, radially inwardly on the floor of the longitudinal depressions 20*a* (at 20*c* in FIG. 3) and radially outwardly centrally between two adjacent longitudinal depressions 20*a* (at 20*d* in FIG. 3), the wall thickness thereof has a smaller value than the respectively adjacent wall portions.

It should also further be noted that the foot box 12 may preferably be made of steel or cast material.

Figure 12:
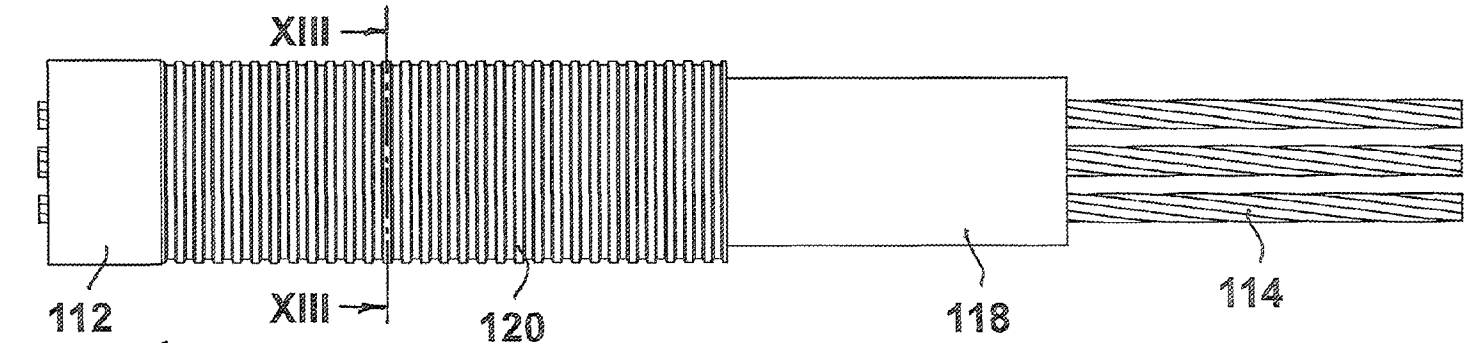
FIG. 11 to 13 are views similar to FIG. 1 to 3 of a second embodiment of a strand pressure-pipe anchor according to the invention, which comprises four strands.
Figure 11:
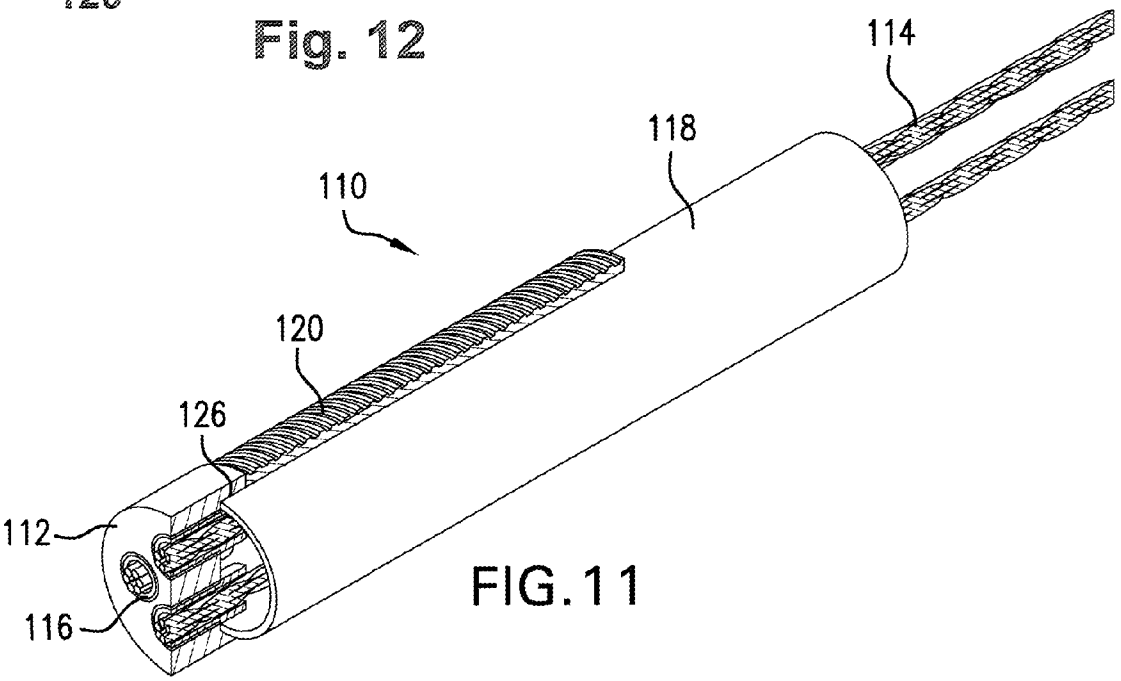
Figure 13:
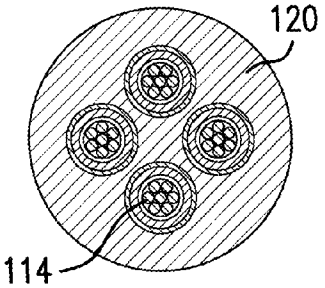

FIG. 11 to 13 show a second embodiment of a strand pressure-pipe anchor according to the invention, which substantially corresponds to the embodiment of FIG. 1 to 10. Therefore, in FIG. 11 to 13, analogous parts are provided with the same reference numerals as in FIG. 1 to 10, but increased by 100. Further, the strand pressure-pipe anchor 110 of FIG. 11 to 13 is only described in the following insofar as it differs from the strand pressure-pipe anchor 10 of FIG. 1 to 10, to the description of which reference is hereby otherwise expressly made.

First, the strand pressure-pipe anchor 110 differs from the strand pressure-pipe anchor 10 in that, instead of having three tension strands, like the strand pressure-pipe anchor 10, it has four tension strands 114. Each of these tension strands 114 may however be formed identically to the tension strands 14, in particular as regards forming the crimp sleeve 116 and pressing it onto the strand 114.

Second, the strand pressure-pipe anchor 110 differs from the strand pressure-pipe anchor 10 in that, instead of a specific sheath being associated with each of the strands 114, all four strands 114 are received in a shared sheath 118. Accordingly, the foot box 112 also comprises merely a single portion 126 having a larger diameter. As in the embodiment of FIG. 1 to 10, the sheath 118 can be screwed to the foot box 112 or connected thereto in a sealing manner using a press fit.

Because of the embodiment using a single sheath 118 and the need to minimise the diameter of the required drill hole, the pressure bodies 120 do not have longitudinal depressions corresponding to the longitudinal depressions 20*a*, in which supply lines for cement mortar could be laid. In this variant, the cement mortar is filled in and grouted via the drill pipe.

Figure 15:
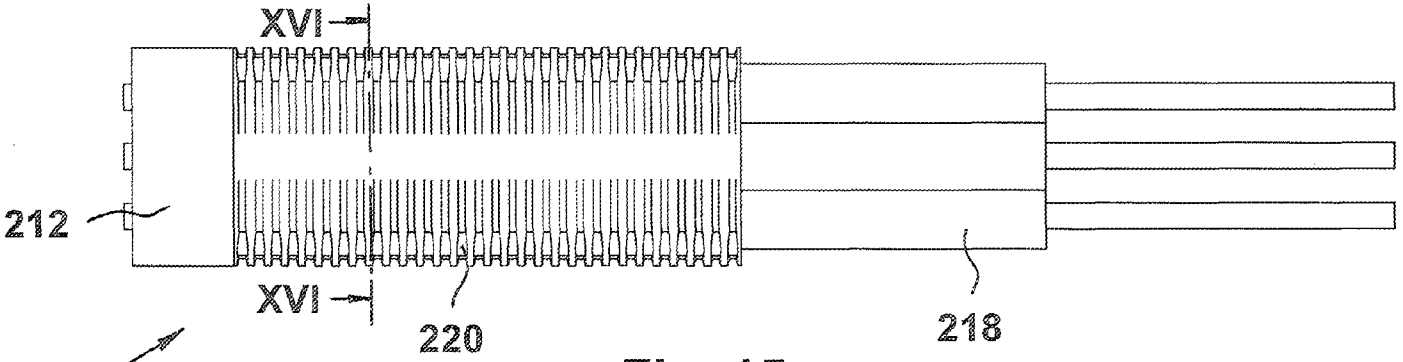
FIG. 14 to 16 are views similar to FIG. 1 to 3 of a second embodiment of a strand pressure-pipe anchor according to the invention, which comprises seven strands.
Figure 14:
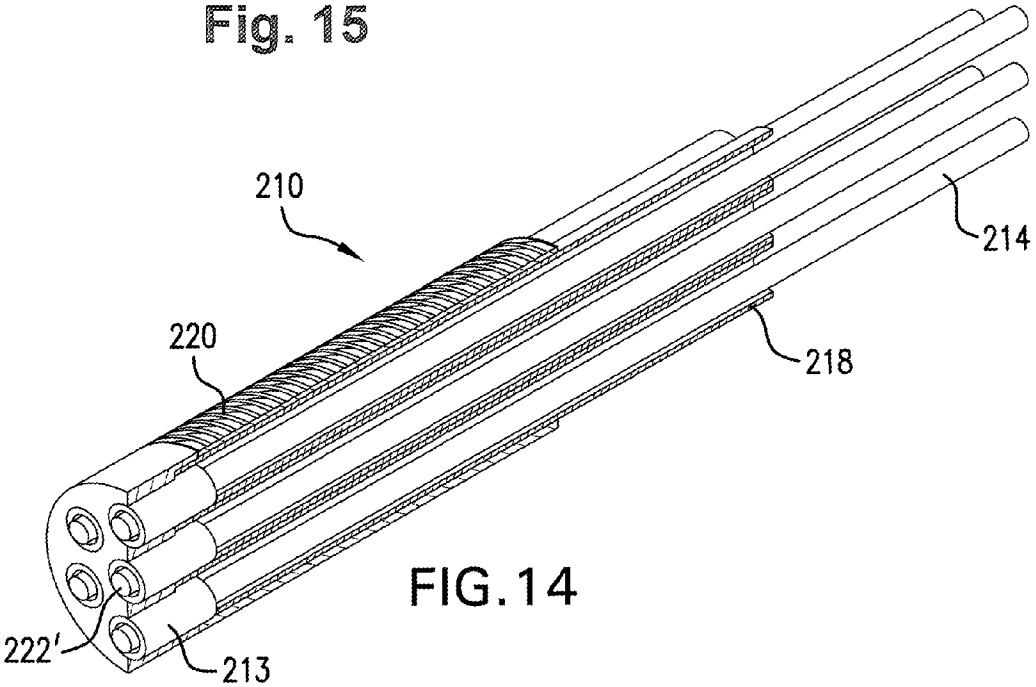
Figure 16:
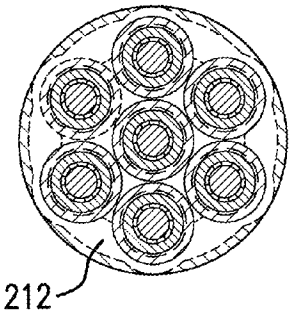

FIGS. 14 to 16, analogous parts are provided with the same reference numerals as in FIGS. 1 to 10, but increased by 200, in other words increased by 100 with respect to FIGS. 11 to 13 (e.g., sheath 218 is analogous to sheaths 18, 118). Further, the strand pressure-pipe anchor 210 of FIGS. 14 to 16 is only described in the following insofar as it differs from the strand pressure-pipe anchor 10 of FIGS. 1 to 10, to the description of which reference is hereby otherwise expressly made.

First, the strand pressure-pipe anchor 210 differs from the strand pressure-pipe anchor 10 in that, instead of having three tension strands, like the strand pressure-pipe anchor 10, it has seven tension strands 214. Each of these tension strands 214 may however be formed identically to the tension strands 14, in particular as regards forming the crimp sleeve 216 and pressing it onto the strand.

Second, the strand pressure-pipe anchor 210 differs from the strand pressure-pipe anchor 10 in that, because of the need to minimise the diameter of the required drill hole, the pressure bodies 220 do not have longitudinal depressions corresponding to the longitudinal depressions 20*a*, in which supply lines for cement mortar could be laid. To grout the cement mortar, it is therefore necessary to proceed in the same manner as for the embodiment of FIG. 11 to 13.

Alternatively, however, a modification is also conceivable in which merely six strands are provided, and the space provided for the seventh strand, for example the central strand, is used for laying a supply line for cement mortar. The receiving hole 222' associated with this supply line should thus be formed as a through-hole, in such a way that the cement mortar sufficiently encloses the foot box 212 and the pressure body 220 on the outer face thereof.

The invention claimed is:

1. A strand pressure-pipe anchor, comprising:

a compression anchor base element, a tension strand or a plurality of tension strands, at least one sheath, in which the tension strand or at least one of the tension strands is received, wherein the tension strand or at least one of the plurality of tension strands is provided, at an end thereof associated with the compression anchor base element, with a crimp sleeve, which is provided with an external thread, which, in a connected state of the tension strand or at least one of the plurality of tension strands and the compression anchor base element where the tension strand or at least one of the plurality of tension strands is connected to the compression anchor base element to pass on anchoring forces to a surrounding substratum, is in screw engagement with an internal thread of the compression anchor base element, wherein the sheath or at least one of the sheaths is connected to the compression anchor base element in a sealing manner, wherein the sheath or at least one of the sheaths is screwed to the compression anchor base element.

2. The strand anchor according to claim 1, wherein a direction of lay of the tension strand or at least one of the plurality of tension strands is the same as a rotational direction of the thread of the crimp sleeve arranged at a free end of the crimp sleeve.

3. The strand anchor according to claim 1, wherein the compression anchor base element comprises, on a surface thereof facing the tension strand or the plurality of tension strands, a depression for the sheath or at least one of the sheaths, into which depression a free end of an associated sheath can be inserted.

4. The strand anchor according to claim 1, wherein if the plurality of tension strands are provided, a specific sheath is associated with at least one tension strand.

5. The strand anchor according to claim 1, further comprising at least one pressure body, which cooperates with the compression anchor base element in passing the anchoring forces to the surrounding substratum.

6. The strand anchor according to claim 5, wherein a plurality of ribs extending in a peripheral direction are provided on an outer face of the at least one pressure body.

7. The strand anchor according to claim 5, wherein the at least one pressure body is formed free of ribs extending in a peripheral direction at a point where a through-opening, intended for passing the tension strand or one of the tension strands therethrough, is located.

8. The strand anchor according to claim 5, wherein the at least one pressure body encloses the tension strand or the plurality of tension strands, and has an end face thereof which faces the compression anchor base element and is positioned, in a planar manner, against the compression anchor base element or a further pressure body.

9. The strand anchor according to claim 5, wherein, on an outer peripheral face thereof, the at least one pressure body has at least one depression extending substantially in parallel with a longitudinal extension direction of the tension strand or the plurality of tension strands.

10. The strand anchor according to claim 1, wherein the at least one sheath is dimensioned or formed, at least at an end portion thereof adjacent to the compression anchor base element, in such a way that, during introduction into the at least one sheath connected to the compression anchor base element, the external thread of the crimp sleeve of the associated tension strand or at least one of the plurality of tension strands is inserted into the internal thread of the compression anchor base element by insertion movement of the tension strand or at least one of the plurality of tension strands.

11. A strand pressure-pipe anchor, comprising:

a compression anchor base element, a tension strand or a plurality of tension strands, at least one sheath, in which the tension strand or at least one of the tension strands is received, wherein the tension strand or at least one of the plurality of tension strands is provided, at an end thereof associated with the compression anchor base element, with a crimp sleeve, which is provided with an external thread, which, in a connected state of the tension strand or at least one of the plurality of tension strands and the compression anchor base element where the tension strand or at least one of the plurality of tension strands is connected to the compression anchor base element to pass on anchoring forces to a surrounding substratum, is in screw engagement with an internal thread of the compression anchor base element, further comprising at least one pressure body, which cooperates with the compression anchor base element in passing the anchoring forces to the surrounding substratum, wherein a plurality of ribs extending in a peripheral direction are provided on an outer face of the at least one pressure body.

12. The strand anchor according to claim 11, wherein the at least one pressure body encloses the tension strand or the plurality of tension strands, and has an end face thereof which faces the compression anchor base element and is positioned, in a planar manner, against the compression anchor base element or a further pressure body.

13. The strand anchor according to claim 11, wherein, on an outer peripheral face thereof, the at least one pressure body has at least one depression extending substantially in parallel with a longitudinal extension direction of the tension strand or the plurality of tension strands.

14. The strand anchor according to claim 11, wherein the sheath or at least one of the sheaths is connected to the compression anchor base element in a sealing manner.

15. The strand anchor according to claim 14, wherein the compression anchor base element comprises, on a surface thereof facing the tension strand or the plurality of tension strands, a depression for the sheath or at least one of the sheaths, into which depression a free end of an associated sheath can be inserted.

16. The strand anchor according to claim 11, wherein a direction of lay of the tension strand or at least one of the plurality of tension strands is the same as a rotational direction of the thread of the crimp sleeve arranged at a free end of the crimp sleeve.

17. The strand anchor according to claim 11, wherein if the plurality of tension strands are provided, a specific sheath is associated with at least one of the plurality of tension strands.

18. The strand anchor according to claim 11, wherein the at least one pressure body is formed free of ribs extending in a peripheral direction at a point where a through-opening, intended for passing the tension strand or one of the tension strands therethrough, is located.

19. The strand anchor according to claim 11, wherein the at least one sheath is dimensioned or formed, at least at an end portion thereof adjacent to the compression anchor base element, in such a way that, during introduction into the at least one sheath connected to the compression anchor base element, the external thread of the crimp sleeve of the associated tension strand or at least one of the plurality of tension strands is inserted into the internal thread of the compression anchor base element by insertion movement of the tension strand or at least one of the plurality of tension strands.

* * * * *